United States Patent [19]

Weatherston

[11] 4,033,708

[45] * July 5, 1977

[54] ROTARY COMPRESSOR

[75] Inventor: Roger C. Weatherston, Williamsville, N.Y.

[73] Assignee: Calspan Corporation, Buffalo, N.Y.

[ * ] Notice: The portion of the term of this patent subsequent to Mar. 2, 1993, has been disclaimed.

[22] Filed: Jan. 30, 1976

[21] Appl. No.: 654,138

Related U.S. Application Data

[63] Continuation-in-part of Ser. No. 501,034, Aug. 28, 1974, Pat. No. 3,941,521.

[52] U.S. Cl. ..... 418/9; 418/206

[51] Int. Cl.² ..... F04C 13/00; F04C 17/10

[58] Field of Search ..... 418/9, 201, 205, 206

[56] References Cited

UNITED STATES PATENTS

| | | | |
|---|---|---|---|
| 158,277 | 12/1874 | Holcomb et al. | 418/201 |
| 2,266,820 | 12/1941 | Smith | 418/201 X |
| 2,515,201 | 7/1950 | Dulmage et al. | 418/201 X |
| 2,670,188 | 2/1954 | Erdmenger | 418/201 X |
| 2,839,240 | 6/1958 | Bechtold | 418/9 |
| 3,602,617 | 8/1971 | Takahashi | 418/206 X |
| 3,817,667 | 6/1974 | Winkelstrater | 418/206 |
| 3,894,822 | 7/1975 | Abaidullin et al. | 418/191 |
| 3,941,521 | 3/1976 | Weatherston | 418/206 X |

FOREIGN PATENTS OR APPLICATIONS

| | | | |
|---|---|---|---|
| 106,899 | 6/1927 | Austria | 418/201 |
| 200,547 | 7/1923 | United Kingdom | 418/201 |

*Primary Examiner*—Carlton R. Croyle
*Assistant Examiner*—Leonard Smith
*Attorney, Agent, or Firm*—Allen J. Jaffe

[57] ABSTRACT

A rotary compressor having a pair of rotatable impellers in mating engagement in working chambers, each impeller having a plurality of constant cross-sectional profiles, each profile having a plurality of lobes and wells, the trailing well region of each profile communicating with the working chambers and an outlet located out of the plane of at least one of the profiles on each impeller.

33 Claims, 10 Drawing Figures

ROTARY COMPRESSOR

This is a continuation-in-part of application Ser. No. 501,034 filed Aug. 28, 1974, now U.S. Pat. No. 3,941,521.

The present invention relates to rotary compressors and, more particularly, to a rotary compressor so constructed and arranged as to provide an efficiency increasing precompression of the fluid in each of the working chambers prior to the fluid's exposure to the discharge passage.

Presently, there are generally two types of rotary compressors that have noncontacting working members which act upon the fluid. These are of the roots-type and the screw-type. The main advantages of both of these apparatus is that there is no need for lubrication and the fluid compression process may be absolutely oil free.

However, both the roots-type and the screw-type of compressor have undesirable intrinsic characteristics which are overcome according to the teachings of the present invention. The roots compressor has a simple two-dimensional impeller profile but because there is no precompression of the fluid the compression process is relatively inefficient, being only 75% at a compression ratio of two and 65% at a compression ratio of three even if all tare and leakage losses are neglected. The screw compressor, on the other hand, has a complicated three-dimensional contour which is very expensive to manufacture and which gives rise to high internal leakage losses.

The foregoing disadvantages of the prior apparatus are overcome according to the teachings of the present invention which provides a rotary fluid compressor that is efficient and inexpensive to manufacture.

In copending U.S. application Ser. No. 441,929, filed Feb. 12, 1974 for Rotary Compressor now U.S. Pat. No. 3,844,695 and assigned to the assignee of the present invention, there is disclosed various embodiments for obtaining a precompression of the working fluid prior to its exposure to the discharge passage. One of these embodiments depicts a pair of impellers each having two profiles, one in the plane of the discharge port and the other in a plane spaced therefrom. One profile in the plane of the discharge port functions to cyclically seal the discharge port to thereby permit fluid in both working chambers to experience a simultaneous increase in pressure prior to exposure to the discharge port. A precompression is thereby achieved simultaneously in both working chambers.

The present invention, on the other hand, provides apparatus which permits the fluid in each working chamber to undergo separate precompressions. Thus, fluid is precompressed in each working chamber independently of the action in the other working chamber. Moreover, the discharge port is always receiving fluid from one of the two working chambers. In this manner the flow of discharge fluid is continuous resulting in an increased compressor efficiency and smoother operation.

Basically the present invention provides a pair of coacting impellers each having two or more constant cross-sectional profiles at least one of which is out of the plane of the discharge port. Each profile has one or more lobes and one or more wells, with the lobes of any one profile angularly displaced from those of the profile immediately adjacent thereto. The arrangement is such that inlet fluid sequentially passes through and is progressively trapped in the decreasing total well volume of the profiles prior to exposure to the discharge port. The pressure of the fluid is therefore increased above that of the inlet prior to communication between the well or wells of the profile in the plane of the discharge port and the discharge port.

For a fuller understanding of the present invention reference should now be had to the following detailed description thereof taken in conjunction with the accompanying drawings wherein.

Figure 1:
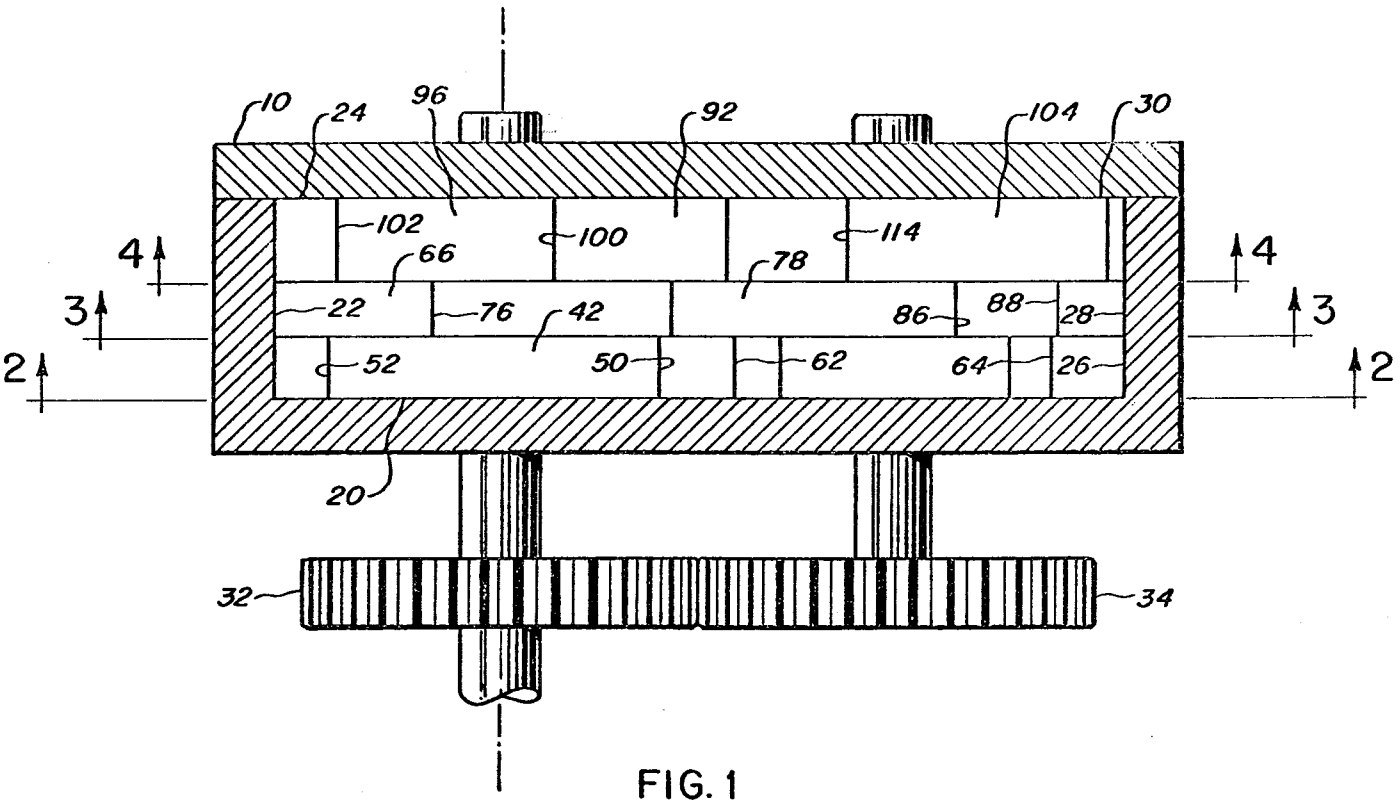
FIG. 1 is a plan sectional schematic of the compressor impellers taken along line 1—1 of FIG. 2.

Referring now to the drawings, a housing 10 provides a pair of working chambers 12 and 14 which, respectively, receive a pair of rotatable, mating impellers 16 and 18. Impeller 16 is suitably mounted for rotation in the direction of arrow A and is comprised of a plurality of two dimensional or constant cross-sectional profiles 20, 22 and 24. Similarly, impeller 18 is suitably mounted for rotation in the direction of arrow B and is comprised of a plurality of two dimensional or constant cross-sectional profiles 26, 28 and 30. Profiles 20 and 26, 22 and 28 and 24 and 30 are complimentary and are in mating engagement. Although three profiles are shown on each impeller, this is for illustrative purposes only and it is within the purview of the present invention to provide a lesser or greater number of profiles. Impellers 16 and 18 may be driven and timed by a pair of gears 32 and 34, as is conventional.

Figure 4:
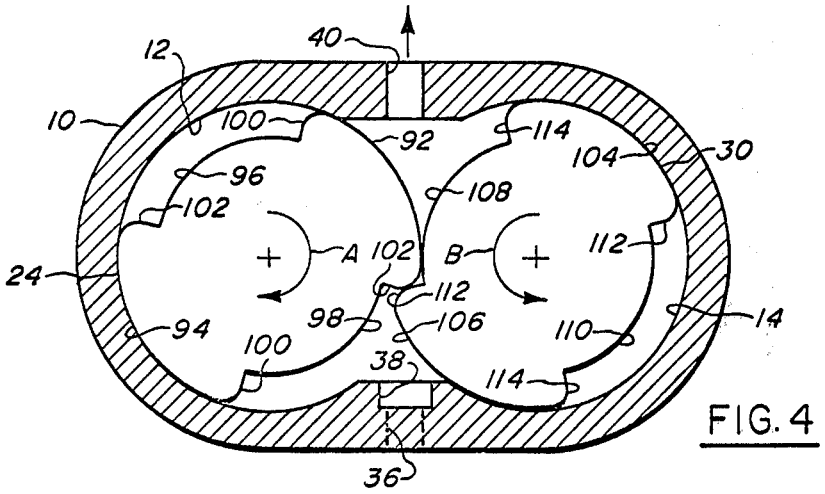
FIG. 4 is a sectional view taken along line 4—4 of FIG. 1.

An inlet passage 36 communicates with each working chamber substantially along the entire depths thereof by means of a slot or the like 38, whereas a discharge port or passage 40 communicates with each working chamber only in the plane of impeller profiles 24 and 30 as illustrated in FIG. 4.

Profile 20 is comprised of a plurality of lobes 42 and 44 with a plurality of wells 46 and 48 therebetween. The lobes 42 and 44 are sealingly engaged with the interior surface of working chamber 12 and are joined to the wells 46 and 48 by concave transition surfaces 50 and 52. Similarly, profile 26 is comprised of a plurality of lobes 54 and 56 with a plurality of wells 58 and 60 therebetween. The lobes 54 and 56 are sealingly engaged with the interior surfaces of working chamber 14 and are joined to the wells 58 and 60 by concave transition surfaces 62 and 64. Lobes 42 and 44 respectively engage and mate with wells 58 and 60 whereas lobes 54 and 56 respectively engage and mate with wells 46 and 48.

Profile 22 adjacent profile 20 is comprised of a plurality of lobes 66 and 68 with a plurality of wells 70 and 72 therebetween. The lobes 66 and 68 are sealingly engaged with the interior surfaces of working chamber 12 and are joined to the wells 70 and 72 by concave transition surfaces 74 and 76. Similarly, profile 28 is comprised of a plurality of lobes 78 and 80 with a plurality of wells 82 and 84 therebetween. The lobes 78 and 80 are sealingly engaged with the interior surfaces of working chamber 14 and are joined to the wells 82 and 84 by concave transition surfaces 86 and 88. Lobes 66 and 68 respectively engage and mate with wells 82 and 84 whereas lobes 78 and 80 respectively engage and mate with wells 72 and 70.

Profiles 20 and 26 are angularly displaced from profiles 22 and 28 such that trailing regions of wells 46 and 48 and 58 and 60 overlap and communicate respectively with the leading regions of wells 70 and 72 and 82 and 84. As used herein the term "trailing region" means the region or well volume that is last to pass under the cusp 90 at the joinder of the two working chambers whereas the term "leading region" means the region or well volume that is first to pass under the cusp 90.

Profile 24 adjacent profile 22 is comprised of a plurality of lobes 92 and 94 with a plurality of wells 96 and 98 therebetween. The lobes 92 and 94 are sealingly engaged with the interior surfaces of working chamber 12 and are in the plane of and pass under discharge port 40 to deliver thereto the fluid contained in wells 96 and 98. The lobes 92 and 94 are joined to the wells 96 and 98 by convex transition surfaces 100 and 102. Similarly, profile 30 is comprised of a plurality of lobes 104 and 106 with a plurality of wells 108 and 110 therebetween. The lobes 104 and 106 are sealingly engaged with the interior surfaces of working chamber 14 and are in the plane of and pass under discharge port 40 to deliver thereto the fluid contained in wells 108 and 110. The lobes 104 and 106 are joined to the wells 108 and 110 by convex transition surfaces 112 and 114.

Profiles 24 and 30 are angularly displaced from profiles 22 and 28 such that the trailing regions of wells 70 and 72 and 82 and 84 overlap and communicate respectively with the leading regions of wells 96 and 98 and 110 and 108.

Moreover, the degree of overlap or relative angular displacement between profiles 24 and 20 is such that when leading transition surface 100 becomes exposed to the discharge or outlet, transition surface 52 will have already gone through the mating position. The same relationship is true for profiles 30 and 26.

Figure 5:
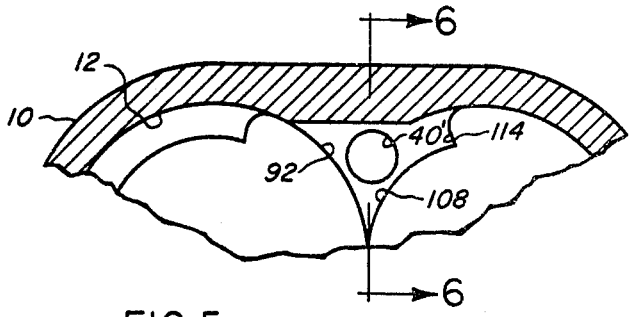
FIG. 5 is a fragmentary sectional view similar to FIG. 4 illustrating an obvious alternate location for the discharge port.
Figure 6:
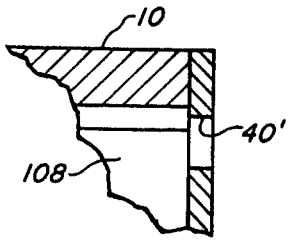
FIG. 6 is a fragmentary sectional view taken along line 6—6 of FIG. 5.

Although each profile has been depicted as havng two lobes and two wells, it is to be understood that this has been for illustrative purposes only and additional lobes and wells can be provided. The axis of discharge port 40 has been illustrated as perpendicular to the axis of rotation of the impellers, however it is obvious that the discharge port axis could be parallel thereto as illustrated at 40' in FIGS. 5 and 6, or have parallel and perpendicular components.

Figure 2:
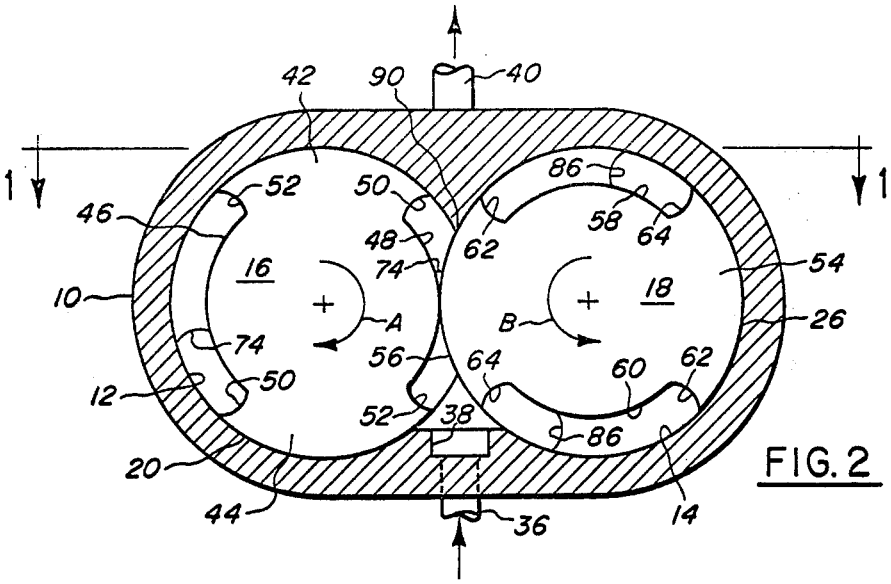
FIG. 2 is a sectional view taken along line 2—2 of FIG. 1.

In the operation of the apparatus according to the present invention, inlet fluid is delivered via port 36 and slot 38 to each of the wells or well volumes of each profile as they become exposed to the inlet region. Thus, as shown in FIG. 2, well 60 has just about been fully charged with inlet fluid whereas well 84 (FIG. 3) is in the process of being filled and well 108 (FIG. 4) has not yet become exposed to the inlet. The wells 58, 82 and 110 all contain fluid at inlet pressure trapped therein. It is therefore clear that in the illustrated position of impellers the well volumes of each profile contain trapped fluid at inlet pressure. As well 58 passes under cusp 90 and mates with lobe 42 the fluid contained therein is forced into well 82 of the adjacent profile, via the overlap between the two profiles 26 and 28. Since the same amount of fluid now occupies a smaller volume the pressure of the fluid increases above that of the inlet. A second precompression of the fluid similarly occurs when well 82 passes under cusp 90 and mates with lobe 66 in that the fluid in well 82 is now forced into well 110 of the adjacent profile via the overlap between the profiles 28 and 30. Thus the fluid at inlet pressure in the three well volumes now exists at an elevated pressure in only one well volume. As the fluid in well 110 is exposed to the outlet 40 and well 110 coacts with lobe 94 the gas is forced out of the discharge in a conventional manner.

Although the foregoing operation has been described with respect to one well of each profile of each impeller it should be apparent that the same action occurs in the other well of each profile and in each well of the profiles of the other impeller. Thus for the illustrated apparatus there are four separate total precompressions of the fluid, prior to its exposure to the outlet, for each cycle or revolution of the impellers. It should be further apparent that the precompressions occur in each working chamber independently. There is no need or requirement that fluid be transferred from one working chamber to the other in order to achieve the efficiency increasing precompression.

Figure 3:
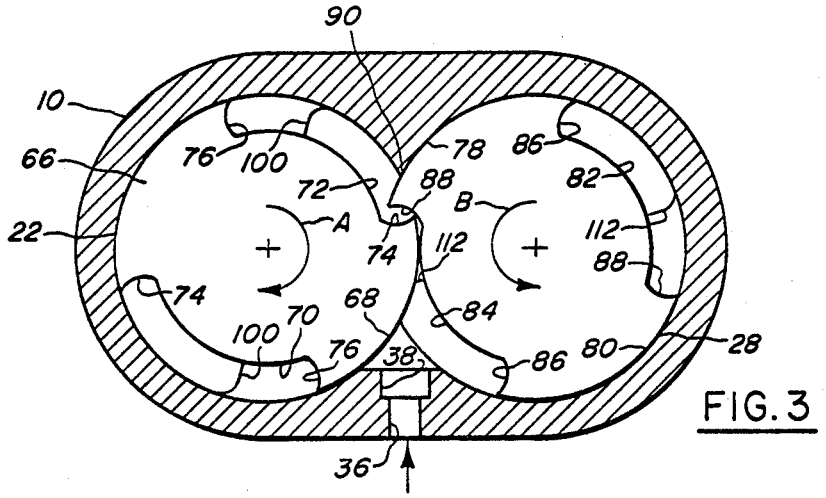
FIG. 3 is a sectional view taken along line 3—3 of FIG. 1.

It is important to note that the transition surfaces 50, 52, 62, 64, and 74, 76 on the profiles which are out of the plane of the outlet 40 are substantially concave in shape whereas the transition surfaces 100, 102 and 112, 114 on the profile in the plane of the outlet can be more arbitrary in shape and are shown to be substantially convex. The reason for the concave transition surfaces is explained as follows: When the wells of profiles 24 and 30 are exposed to the high pressure outlet, as is well 108 in FIG. 4, it is necessary to prevent high pressure fluid leaking back to low pressure well 72 through well 108 as leading edge 88 mates with trailing edge 74. As can be seen in FIG. 3 due to their concave shape the tip of edge 74 seals throughout the entire side face of surface 88 to thereby block flow from well 108 to well 72. If edge 88 was not concave such a sealing action could not be attained and there would be an interstage leak. Likewise edges 50, 64 and 76 must also be concave to provide this interstage sealing action.

In the foregoing description of the structure and operation of the present invention, no special emphasis was placed on the relative thicknesses or depths of the profiles on each impeller nor to the specific angular displacements therebetween. However, depending upon the desired compression ratio of the compressor, certain relationships between the profiles on each impeller are important in obtaining the greatest precompression.

Figure 7:
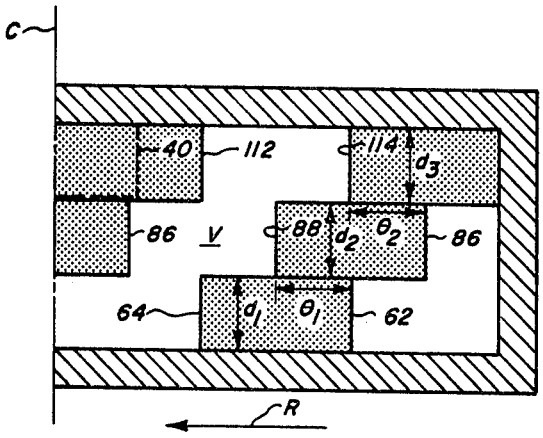
FIG. 7 is a developed view of one impeller illustrating the effect of strutural relationships on the precompression process.
Figure 8:
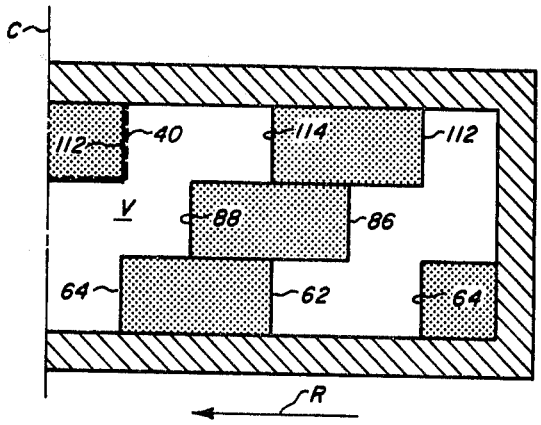
FIG. 8 is a developed view similar to FIG. 7 illustrating the completion of the precompression process.
Figure 9:
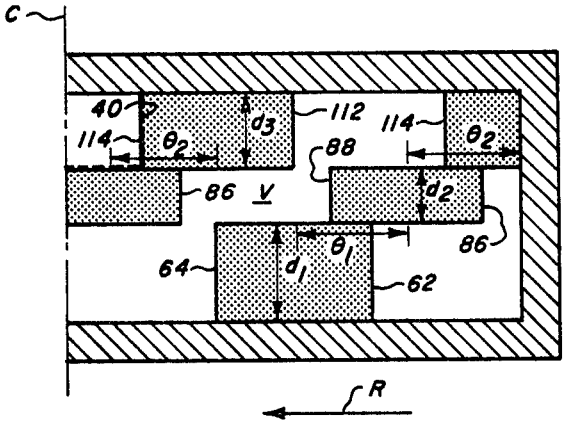
FIG. 9 is a developed view, similar to FIG. 7, illustrating structural relationships necessary to optimize the precompression process.
Figure 10:
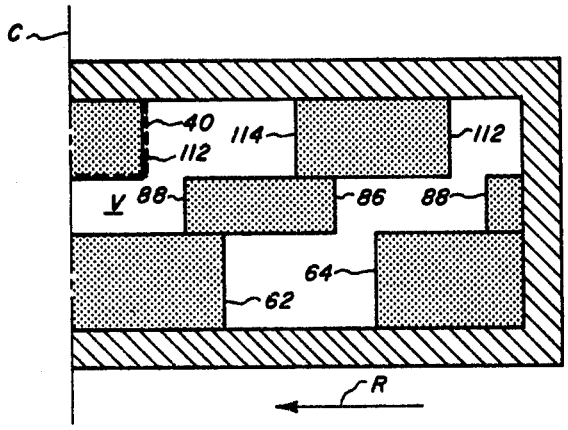
FIG. 10 is a developed view similar to FIG. 9 illustrating the completion of the precompression process.

Thus, FIGS. 7 and 8 illustrate developed views of one set of relationships which are satisfactory for compression ratios below two whereas FIGS. 9 and 10 illustrate developed views of a second set of relationships which are suitable for compression ratios greater than two.

More specifically, FIG. 7 is a developed view of one impeller showing the start of the precompression process and FIG. 8 shows the relative profile positions at the completion thereof. For ease in explanation only one impeller is shown, however the operation is the same for the other impeller as well. The line C represents a line through the pitch points which separates the two impellers and prevents flow therebetween. $\theta_1$ and $\theta_2$ represent the angular displacements defined as the arcuate angular lag between the lobe centers of adjacent profiles of the impeller whereas $d_1$, $d_2$ and $d_3$ represent the respective axial thicknesses of each profile. The common gas volume located between the profiles is designated at V. Since FIGS. 7 and 8 are developed views the space between the leading edge of one lobe to the leading edge of the other on each profile represents 180 arcuate degrees and $\theta_1$ and $\theta_2$ are shown as substantially 45 arcuate degrees. The thicknesses $d_1$, $d_2$ and $d_3$ are substantially equal. In FIG. 7, the trapped well volume V is shown at the beginning of the precompression process where port 40 is blocked from communication with the well volume between trailing edge 112 and leading edge 114. Thus, the gas in volume V is trapped. This entrappment continues as the impeller rotates in the direction of arrow R causing the volume V to decrease until the position of FIG. 8 is reached. In FIG. 8 the trailing edge 112 has just passed discharge port 40 whereby further movement establishes communication with the volume V to end the precompression process. The magnitude of precompression is determined by a comparison between the trapped volume V in FIG. 8 and the volume V in FIG. 7. It can be seen that the volume V has undergone only about a 15 to 20 percent reduction in volume resulting in only about a 20 to 30 percent build up of pressure before the discharge port is opened. Such a build up while satisfactory to accommodate a pressure ratio of under 2, is less than desirable when higher pressure ratios are to be accommodated.

Moreover, as can best be seen in FIG. 8, when the discharge port 40 is opened the profiles remote from the discharge port are in a discharge mode. That is say, the gas in volume V that lies between leading edge 88 and line C and between leading edge 64 and line C is forced out of discharge port 40 at the very beginning of the discharge process, resulting in a discharge overpressure in the compressor. Such overpressure increases the work required to displace the gas from the compressor.

Greater precompression and lower overpressures can be achieved to accommodate higher compression ratios by modifying the relative dimensional and angular relationships between the profiles in the manner generally suggested in FIGS. 9 and 10, which are developed views, similar to FIGS. 7 and 8, showing, respectively, the start of the precompression process and the completion thereof.

For illustrative purposes only, FIG. 9 shows the profile in the plane of the discharge port (or the one in direct communication with the discharge port) as having a thickness $d_3$ which is about four thirds that of $d_2$, the thickness of the profile immediately adjacent thereto which, in turn, is about three fifths that of $d_1$, the thickness of the profile most remote from the discharge profile, $d_3$. Moreover, the lag angles $\theta_1$ and $\theta_2$ are much greater than those of FIGS. 7 and 8, being about 67°, for example.

A comparison of the trapped well volumes V in FIG. 9 with the trapped well volume V in FIG. 10 indicates a substantial reduction, about 50 percent for the illustrative example given. Such a reduction will permit a precompression pressure buildup of about 170 percent.

Moreover, as can be seen in FIG. 10, when the discharge process begins only the relatively thin profile, $d_2$, is in a displacement mode and the overpressures are greatly reduced in comparison to the FIG. 8 example. The displacement of profile $d_1$ has already been completed in FIG. 10 because of the greater lag angles than existed in the FIG. 8 example.

Although specific dimensional and angular relationships have been given, these should be taken as illustrative, and not as limitations, of the beneficial results of optimizing the precompression process and of reducing the overpressures. In practice it has been found that whenever the profile most remote from the discharge profile is greater than its adjacent profile by at least substantially 20%, the above discussed additional benefits will be achieved. This is true regardless of the total number of profiles. Additionally, or alternatively, the angular displacement between the center of the lobe of the profile most remote from the discharge profile and the center of the lobe of the profile immediately adjacent to such remote profile should be at least substantially 55°. Moreover, the angular displacement between the first profile (most remote from discharge profile) and the discharge profile should be at least substantially 110° regardless of the total number of profiles. To summarize, the greater precompressions and lower overpressures to accommodate compressor pressure ratios in excess of two can be accomplished in one or more of the following ways, taken singly or in combination:

1. The first profile is thicker by at least twenty percent than its immediately adjacent profile;
2. The angular displacement between the centerlines of the lobes of the first and second profile is at least 55°;
3. The total angular displacement between the centerlines of the lobes of the first profile and discharge profile is at least 100°.

Although preferred embodiments of the present invention have been disclosed and described, changes will obviously occur to those skilled in this art. It is therefore intended that the scope of the present invention be limited only by the scope of the appended claims.

I claim:

1. A rotary compressor, comprising:

a. a housing defining two working chambers, b. mating impellers rotatably mounted about an axis in each of said working chambers for rotation in opposite directions, c. each impeller having at least two profiles each of constant cross-section in planes perpendicular to said axis, d. each of said profiles comprised of at least one lobe and at least one well, each well and each lobe being joined by a transition surface, e. an outlet communicating with said housing, f. means for supplying fluid at inlet pressure to the wells of each profile during portions of the rotation cycle of each impeller, whereby in one rotational position of said impellers at least one well of each profile on each impeller contains trapped fluid at inlet pressure, g. at least one of said profiles being out of the plane of said outlet and at least one of said profiles being adjacent said outlet, h. the lobes and wells of any one profile being angularly displaced from those of the profiles immediately adjacent thereto thereby defining in said one rotational position a common well volume of trapped fluid extending from said profile adjacent said outlet to the profile most remote therefrom whereby as said impellers continue to rotate from said one rotational position said common well volume is sequentially reduced by the transfer of trapped fluid from the wells of said most remote profile to said adjacent profile, and i. the angular displacement between said lobes and wells of said profiles on each impeller is such to ensure that never more than one lobe of said adjacent profile is located between said outlet and said common well volume.

2. A rotary compressor, comprising:

a. a housing defining two working chambers, b. mating impellers rotatably mounted about an axis in each of said working chambers for rotation in opposite directions, c. each impeller having at least two profiles each of constant cross-section in planes perpendicular to said axis, d. each of said profiles comprised of at least one lobe and at least one well, each well and each lobe being joined by a transition surface, e. an outlet communicating with said housing, f. means for supplying fluid at inlet pressure to the wells of each profile during portions of the rotation cycle of each impeller, whereby in one rotational position of said impellers at least one well of each profile on each impeller contains trapped fluid at inlet pressure, g. at least one of said profiles being out of the plane of said outlet and at least one of said profiles being adjacent said outlet and h. the lobes and wells of any one profile being angularly displaced from those of the profiles immediately adjacent thereto thereby defining in said one rotational position a common volume of trapped fluid extending from said profile adjacent said outlet to the profile most remote therefrom whereby as said impellers continue to rotate from said one rotational position said common volume is sequentially reduced by the transfer of trapped fluid from the wells of said most remote profile to said adjacent profile with the wells of said most remote profile being substantially exhausted of fluid as the wells of said adjacent profile are exposed to said outlet.

3. The compressor according to claim 2, wherein:

i. the angular displacement between said lobes and wells of said profiles on each impeller is such to ensure that never more than one lobe of said adjacent profile is located between said outlet and said common well volume.

4. The compressor according to claim 2, wherein;

i. the angular displacement between the lobe centerlines of the profile on each impeller that is most remote from said outlet and said profile immediately adjacent said most remote profile is at least substantially 55°.

5. The compressor according to claim 2, wherein;

i. said transition surfaces being substantially concave on at least one profile on each impeller and substantially convex on at least one other profile on each impeller.

6. The compressor according to claim 5, wherein;

j. at least said transition surfaces of said profiles adjacent said outlet being substantially convex.

7. The compressor according to claim 2, wherein;

i. the profile on each impeller that is most remote from said outlet has an axial thickness that is greater than that of the profile immediately adjacent said most remote profile.

8. The compressor according to claim 7, wherein;

j. said axial thickness is at least 20 percent greater than that of said profile immediately adjacent.

9. The compressor according to claim 2, wherein;

i. the angular displacement between the lobe centerlines of the profile on each impeller that is most remote from said outlet and the profile having its wells in communication therewith is at least substantially 110°.

10. The compressor according to claim 9, wherein;

j. there is no more than one profile on each impeller intermediate said profile most remote from said outlet and said profile having its wells in communication therewith.

11. A rotary compressor, comprising:

a. a housing defining two working chambers, b. mating impellers rotatably mounted about an axis in each of said working chambers for rotation in opposite directions, c. each impeller having at least two profiles each of constant cross-section in planes perpendicular to said axis, d. each of said profiles comprised of two lobes and two wells, each well and each lobe being joined by a transition surface, e. an outlet communicating with said housing, f. means for supplying fluid at inlet pressure to the wells of each profile during portions of the rotation cycle of each impeller, whereby in one rotational position of said impellers one well of each profile on each impeller contains trapped fluid at inlet pressure, g. at least one of said profiles being out of the plane of said outlet and at least one of said profiles having one of its wells in communication with said outlet during one portion of its rotation cycle and blocked from communication therewith during another portion of its rotation cycle, and h. the lobes and wells of any one profile being angularly displaced from those of the profiles immediately adjacent thereto whereby as said impellers continue to rotate from said one rotational position, said fluid is transferred sequentially from the wells of one profile to the wells of adjacent profiles and experiences an increase in pressure prior to the establishment of communication between said outlet and the wells of the profiles in communication therewith.

12. The compressor according to claim 11, wherein;

i. the angular displacement between the lobe centerlines of the profile on each impeller that is most remote from said outlet and said profile immediately adjacent said most remote profile is at least substantially 55°.

13. The compressor according to claim 11, wherein;

i. the profile on each impeller that is most remote from said outlet has an axial thickness that is greater than that of the profile immediately adjacent said most remote profile.

14. The compressor according to claim 13, wherein;

j. said axial thickness is at least 20 percent greater than that of said profile immediately adjacent.

15. The compressor according to claim 11, wherein;

i. the angular displacement between the lobe centerlines of the profile on each impeller that is most remote from said outlet and the profile having its wells in communication therewith is at least substantially 100°.

16. The compressor according to claim 15, wherein;

j. there is no more than one profile on each impeller intermediate said profile most remote from said outlet and said profile having its wells in communication therewith.

17. The compressor according to claim 11, wherein;

i. at least said transition surfaces of said profiles out of communication with said outlet being substantially concave.

18. The compressor according to claim 17, wherein;

j. the profile on each impeller that is most remote from said outlet has an axial thickness that is greater than that of the profile immediately adjacent said most remote profile.

19. The compressor according to claim 18, wherein;

k. said axial thickness is at least twenty percent greater than that of said profile immediately adjacent.

20. The compressor according to claim 19, wherein;

l. the angular displacement between the lobe centerlines of the profile on each impeller that is most remote from said outlet and said profile immediately adjacent said most remote profile is at least substantially 55°.

21. The compressor according to claim 20, wherein;

m. the angular displacement between the lobe centerlines of the profile on each impeller that is most remote from said outlet and the profile having its wells in communication therewith is at least substantially 100°.

22. The compressor according to claim 21, wherein;

n. there is no more than one profile on each impeller intermediate said profile most remote from said outlet and said profile having its wells in communication therewith.

23. A rotary compressor, comprising;

a. a housing defining two working chambers, b. mating impellers rotatably mounted about an axis in each of said working chambers for rotation in opposite directions, c. each impeller having at least two profiles each of constant cross-section in planes perpendicular to said axis, d. each of said profiles comprised of at least one lobe and at least one well, each well and each lobe being joined by a transition surface, e. an outlet communicating with said housing, f. means for supplying fluid at inlet pressure to the wells of each profile during portions of the rotation cycle of each impeller, whereby in one rotational position of said impellers at least one well of each profile on each impeller contains trapped fluid at inlet pressure, g. at least one of said profiles being out of the plane of said outlet and at least one of said profiles having one of its wells in communication with said outlet during one portion of its rotation cycle and blocked from communication therewith during another portion of its rotation cycle, h. the lobes and wells of any one profile being angularly displaced from those of the profiles immediately adjacent thereto whereby as said impellers continue to rotate from said one rotational position, said fluid is transferred sequentially from the wells of one profile to the wells of adjacent profiles and experiences an increase in pressure prior to the establishment of communication between said outlet and the wells of the profiles in communication therewith, and i. at least said transition surfaces of said profiles out of communication with said outlet being substantially concave.

24. The compressor according to claim 23, wherein;

j. the angular displacement between the lobe centerlines of the profile on each impeller that is most remote from said outlet and said profile immediately adjacent said most remote profile is at least substantially 55°.

25. The compressor according to claim 23, wherein;

j. the profile on each impeller that is most remote from said outlet has an axial thickness that is greater than that of the profile immediately adjacent said most remote profile.

26. The compressor according to claim 25, wherein;

k. said axial thickness is at least twenty percent greater than that of said profile immediately adjacent.

27. The compressor according to claim 23, wherein;

j. the angular displacement between the lobe centerlines of the profile on each impeller that is most remote from said outlet and the profile having its wells in communication therewith is at least substantially 110°.

28. The compressor according to claim 27, wherein;

k. there is no more than one profile on each impeller intermediate said profile most remote from said outlet and said profile having its wells in communication therewith.

29. The compressor according to claim 23, wherein;

j. said means for supplying fluid comprises a substantially constant cross-sectional channel extending axially and communicating with all of said profiles.

30. The compressor according to claim 29, further comprising;

k. an inlet port communicating with said channel intermediate the ends thereof.

31. A rotary compressor, comprising;

a. a housing defining two working chambers, b. mating impellers rotatably mounted about an axis in each of said working chambers for rotation in opposite directions, c. each impeller having at least two profiles each of constant cross-section in planes perpendicular to said axis, d. each of said profiles comprised of at least one lobe having a peripheral surface of substantially constant radius and at least one well having a peripheral surface of substantially constant radius, each well and each lobe peripheral surface being joined by a transition surface, e. an outlet communicating with said housing, f. means for supplying fluid to the wells of each profile, g. at least one of said profiles being out of the plane of said outlet and at least one of said profiles having one of its wells in communication with said outlet during one portion of its rotation cycle and blocked from communication therewith during another portion of its rotation cycle, h. the lobes and wells of any one profile being angularly displaced from those of the profiles immediately adjacent thereto whereby as said impellers rotate said fluid is transferred sequentially from the wells of one profile to the wells of adjacent profiles and experiences an increase in pressure prior to the establishment of communication between said outlet and the wells of the profiles in communication therewith, and i. said transition surfaces being sustantially concave on at least one profile on each impeller and substantially convex on at least one other profile on each impeller.

32. The compressor according to claim 31, wherein;

j. at least said transition surfaces of said profiles out of communication with said outlet being substantially concave.

33. The compressor according to claim 31, wherein;

j. at least said transition surfaces of said profiles in communication with said outlet being substantially convex.

* * * * *